US006712103B2

(12) United States Patent
Komaba

(10) Patent No.: US 6,712,103 B2
(45) Date of Patent: Mar. 30, 2004

(54) GAS CONTAINER

(76) Inventor: Kunio Komaba, 2-2-5 Morishita, Koto-ku Tokyo (JP), 135-0004

( * ) Notice: Subject to any disclaimer, the term of this patent is extended or adjusted under 35 U.S.C. 154(b) by 0 days.

(21) Appl. No.: 09/848,184

(22) Filed: May 3, 2001

(65) Prior Publication Data

US 2001/0042573 A1 Nov. 22, 2001

(30) Foreign Application Priority Data

May 9, 2000 (JP) ..... 2000-136136
Jul. 31, 2000 (JP) ..... 2000-232232

(51) Int. Cl.[7] ..... B65B 1/04
(52) U.S. Cl. ..... 141/114; 141/67; 222/215
(58) Field of Search ..... 141/114, 2, 18, 141/98, 67, 65; 222/94, 105, 206, 215

(56) References Cited

U.S. PATENT DOCUMENTS 2,861,718 A * 11/1958 Winzen ..... 222/105
3,349,965 A * 10/1967 Krugger ..... 222/105
4,622,085 A * 11/1986 Yamada et al. ..... 141/1
5,137,175 A * 8/1992 Kowalski et al. ..... 141/114
5,967,199 A * 10/1999 Riddiford et al. ..... 141/114

* cited by examiner

*Primary Examiner*—Steven O. Douglas
(74) *Attorney, Agent, or Firm*—Norris McLaughlin & Marcus

(57) ABSTRACT

A gas container having a deformable outer container body, an inner bag, which has a gas barrier characteristic, and an outlet/inlet formed within the inner bag. A gas is charged into the inner bag through the outlet/inlet and discharged there by applying a pressure to the outer container body from outside. According to the invention, all of the gas held in the container can be used without leaving any remaining gas waste. In addition, the container can be re-used.

8 Claims, 5 Drawing Sheets

GAS CONTAINER

BACKGROUND OF THE INVENTION

1) Field of the Invention

The present invention relates to a gas container for use in holding Helium gas, Oxygen gas, Nitrogen gas, etc. at a comparatively low pressure. More particularly, the present invention relates to a gas container which is suitably used for filling up balloons with a gas to inflate them.

2) Related Art Statement

A gas cylinder is conventionally used to inflate balloons by filling them up with Helium gas. According to the Japanese law for handling gas with a high pressure, a pressure test must be conducted to inspect gas cylinders when the cylinders are used with a pressure of more than 10 atmospheres at a temperature of 35° C. Therefore, most of the cylinders for containing Helium gas are set so as not to come over a pressure of more than 10 atmospheres.

However, such cylinders have a problem that when the pressure in the cylinder becomes 1 atmosphere, it is impossible to inflate balloons any more, even though some Helium gas is still left in the cylinder; then the gas left in the cylinder becomes waste.

Further, such cylinders should be re-cycled or reused after the remaining gas in the cylinder is exhausted. However, such cylinders, where gas is still left, are sometimes incorrectly thrown into a furnace for the purpose of recycling; these cylinders explode during the waste burning process. This causes another problem, namely dealers for recycling do not accept such cylinders because of the danger.

The present invention has for its purpose to solve the above-mentioned problem, and particularly to provide a gas container, by which all of the gas left in the container can be used without causing any remaining waste of gas, being easy to reuse or recycle, and friendly to the environment.

SUMMARY OF THE INVENTION

In order to solve the above-mentioned problem, a gas container according to the present invention comprises: a deformable container body, an inner bag made of a material having a gas barrier characteristic being contained inside said container body; a gas supply means being formed within said inner bag for filling said inner bag, wherein the gas contained in the container body can be discharged from the container body through the gas supply means by applying a pressure against the container body from outside thereof.

It should be noted that the outer container body may be formed of a thick paper material such as corrugated cardboard.

Further, the container body may be made of a fabric having a non-stretchable character.

It is preferred that said inner bag is made of a material having a water solvable characteristic.

The gas container according to the invention has another aspect that the container is constituted of a bag made of a thick synthetic resin having a gas barrier characteristic, and a gas supply means being formed within the bag; wherein a gas is supplied into the bag through the gas supply means to fill the bag, and the gas contained in the bag is discharged through said gas supply means by applying a pressure against the outer side of said bag.

The gas container according to the invention may have a pump means so as to discharge the gas filled in the container by means of the pump.

Furthermore, the gas container according to the invention may comprise a protruded portion at the bottom thereof so that an operator can place his or her foot thereon in order to prevent that the container rises up. Alternatively, the gas container may have a holding means to keep itself attached to some stable member, for instance, a wall, a stand, etc.

BRIEF DESCRIPTION OF THE DRAWING

FIG. 2(*b*) is a schematic view illustrating the detail of the gas container shown in FIG. 1, where the inlet/outlet tube is unfolded and connected to a balloon.

DETAILED DESCRIPTION OF THE PREFERRED EMBODIMENTS

Figure 1:
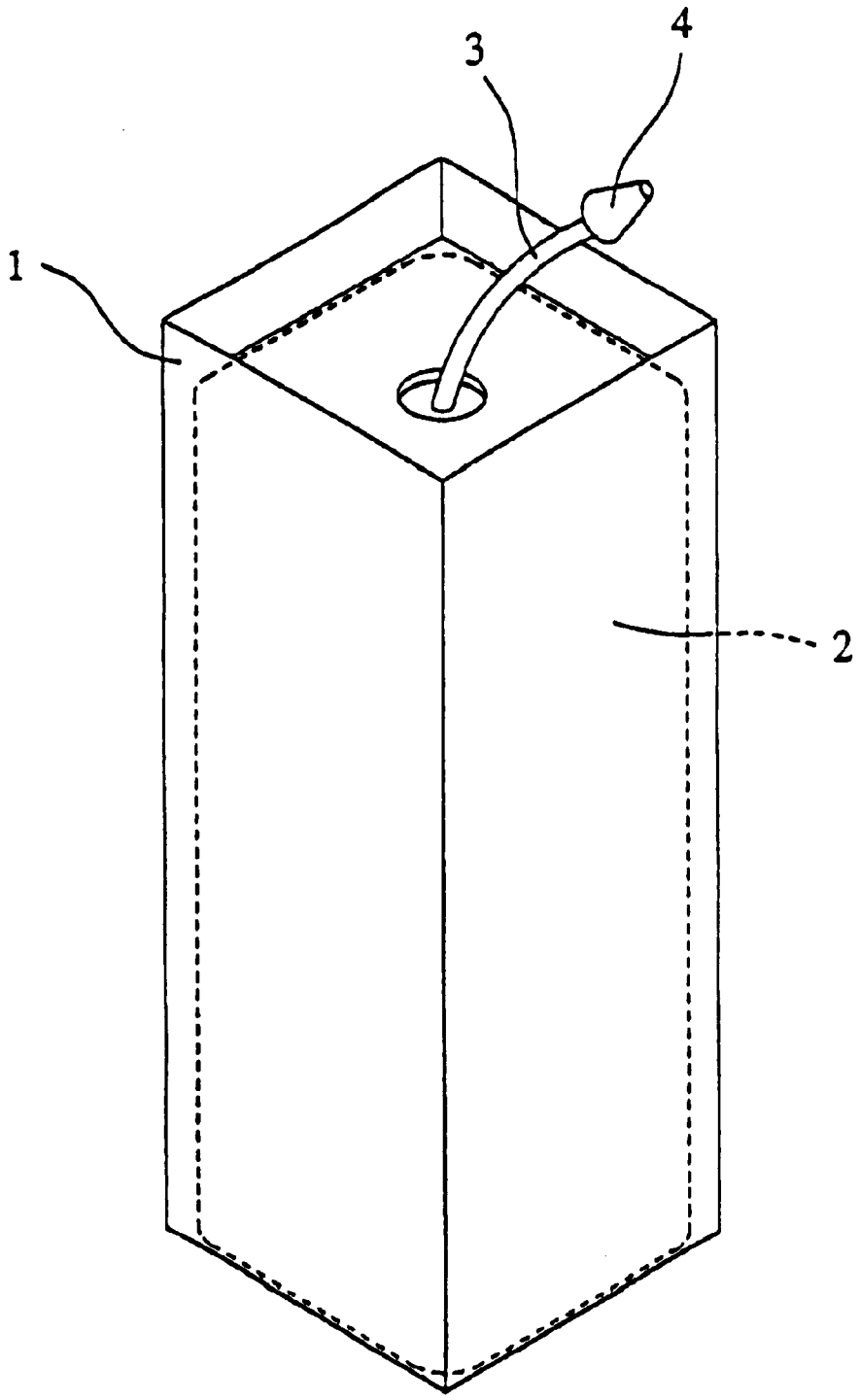
FIG. 1 is a perspective view showing a first embodiment of the gas container according to the present invention.

Embodiments according to the invention will be explained, referring to the drawings.

FIG. 1 is a schematic view showing a first embodiment of the gas container according to the present invention. The container comprises a box-shaped container body 1 made of a corrugated cardboard material, and an inner bag 2 which is made of plastic film having a gas barrier characteristic. The bag 2 is contained inside the container body 1. In the embodiments which will be explained below, Helium gas is charged in the inner bag 2 and the gas is injected into an object to be inflated, e.g. balloon.

Figure 2A:
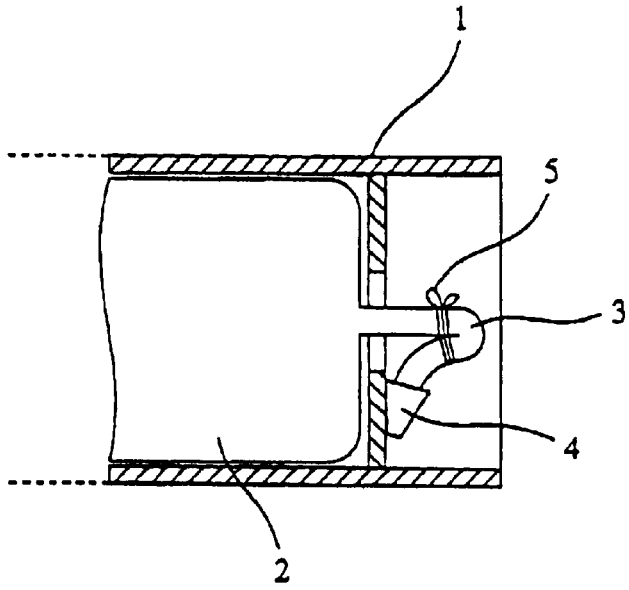
FIG. 2(*a*) is a schematic view depicting the detail of the gas container shown in FIG. 1, where the inlet/outlet tube is folded.
Figure 2B:
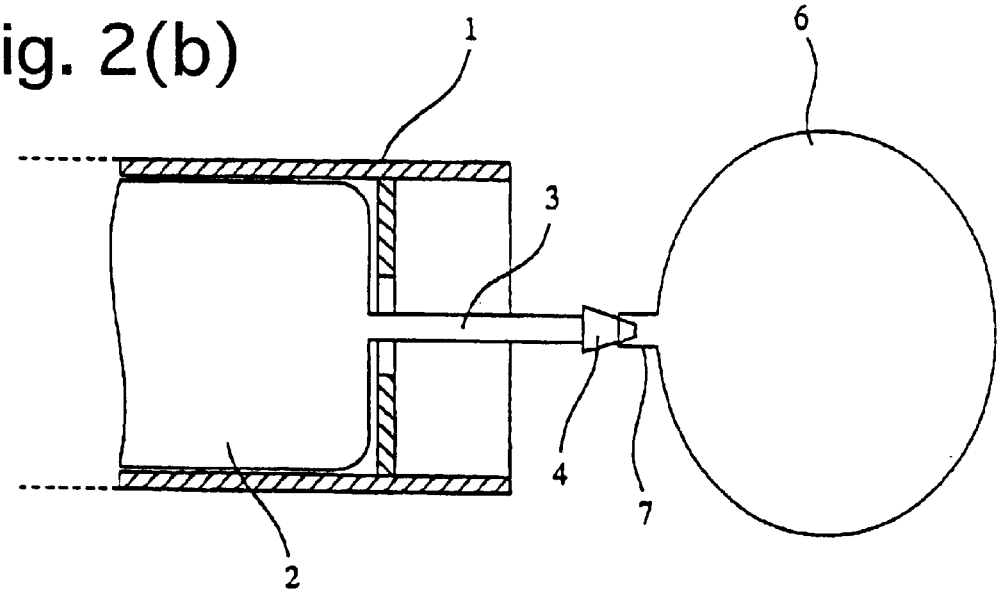

The inner bag 2 is made of a film having a gas barrier characteristic and has a bigger size than that of the container body 1. At an end of the inner bag 2, a gas supply inlet/outlet 3 is provided, being protruded from the container body 1. The inlet/outlet 3 has a long tube shape; a nozzle 4 having a tapered-shape end is provided on the top of the tube. As shown in FIG. 2(*a*), the tube is folded and the folded portion is fixed by a suitable closing means 5, such as a rubber band or a clip in order to prevent that the Helium gas in the inner bag 2 leaks therefrom.

Referring to FIG. 2(*b*), a balloon 6 is mounted to the nozzle 4. The balloon 6 having a bag shape is made of plastic film, and on the surface of the balloon 6, is provided a metal thin film, such as a thin Aluminum film, which has a high gas barrier characteristic. In case of inflating the balloon 6 with Helium gas, the top end of the gas inlet/outlet 3 is inserted in the inlet 7 of the balloon 6, then the closing means 5 is removed to make the tube 3 straight. Due to this operation, the Helium gas in the bag 2 flows into the balloon 6 through the gas inlet/outlet 3 and the inlet 7 of the balloon; the balloon 6 is then inflated with Helium gas.

As the Helium gas is transferred into the balloon 6, the pressure of Helium gas in the inner bag 2 becomes lower. Then, a pressure may be applied onto the outside surface of the container body 1, i.e. onto the inner bag 2 via the container body 1, to discharge the Helium gas from the inner bag 2 to transfer it into the balloon 2. By deforming the container body 1 so as to completely squash the container body 1, all of the Helium gas contained in the inner bag 2 can be transferred into the balloon 6 to inflate it without generating any remaining waste of gas.

A container body 1 having a dimension, for instance, of 50 cm (length)×50 cm (width)×120 cm(height), can charge 30 liters of Helium gas. This means about 20 balloons each having a capacity of 15 liters can be inflated.

Since the container body 1 is made of corrugated cardboard material, it is possible to burn both the container body 1 and the inner bag 2 or to reuse the inner bag 2. By using a material, which does not generate a noxious gas when it is burnt, for the inner bag 2, it becomes very easy to handle used containers and keep them friendly to the environment.

Further, by making the intensity of the container 1 high so as to be able to charge Helium gas with a pressure of several atmospheres, much more Helium gas can be prepared within a smaller container. Therefore, more balloons can be inflated by using such containers wherein Helium is contained under a high pressure. Such containers save storage space.

Figure 3:
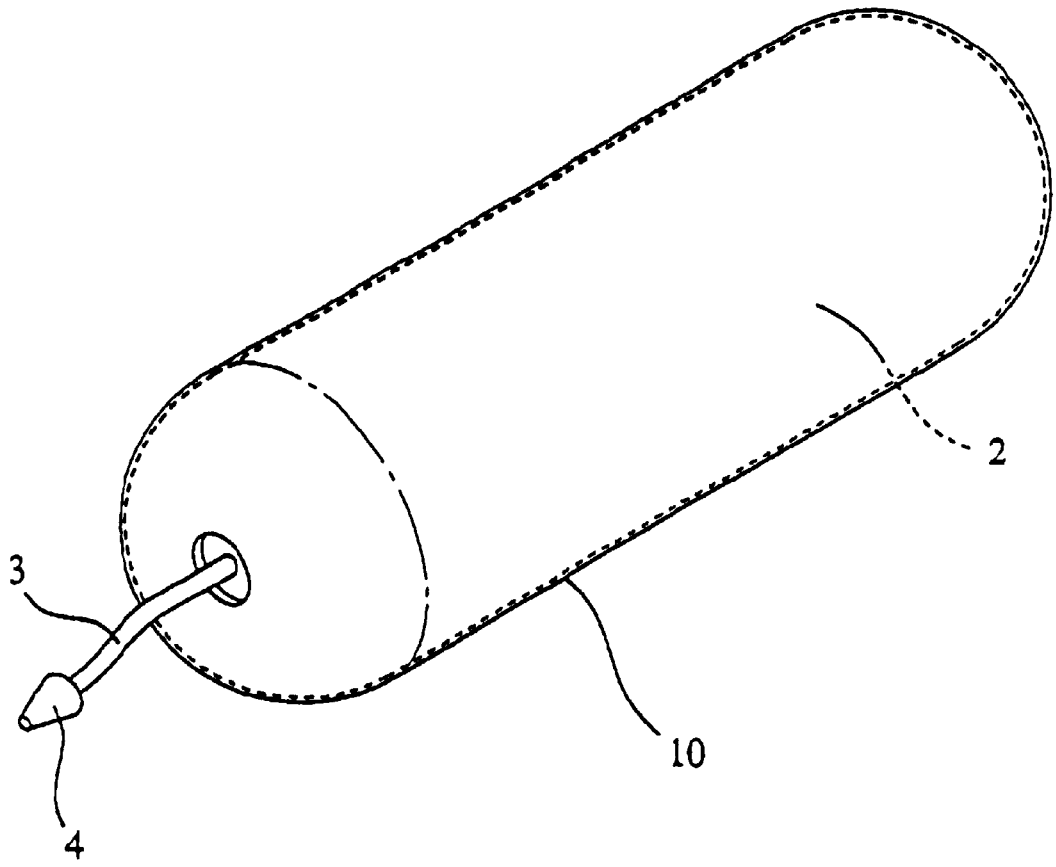
FIG. 3 is a perspective view representing a second embodiment of the gas container according to the present invention.

FIG. 3 shows a second embodiment of the gas container according to the invention. In the third embodiment, the container body 10 is constituted of an outer bag made of non-stretch fabric (for instance, a fabric for use in automobile seat belts), which is woven using high density fibers. The inner bag 2 having a gas barrier characteristic, which is explained above, is contained inside of the fabric outer bag 10.

In the second embodiment, when injecting Helium gas into a balloon 6, the top end of the gas inlet/outlet 3 of the container is inserted into the gas inlet 7 of the balloon 6 and the bent portion of the inlet/outlet 3 is unfolded. Then, the Helium gas contained in the bag 2 flows into the balloon 6 via the inlet/outlet 3 and the inlet 7 of the balloon 6 to inflate it with the Helium gas.

Figure 4A:
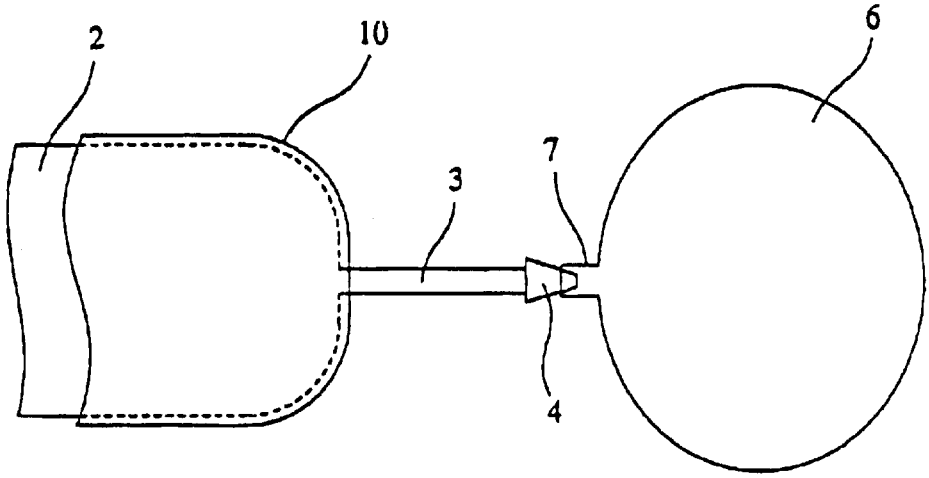
FIG. 4(*a*) is a schematic view showing the top of the gas container where the inlet/outlet tube of the container is connected to the balloon 6, and FIG. 4(*b*) is a schematic view depicting how to transfer the gas contained in the container to the balloon.
Figure 4B:
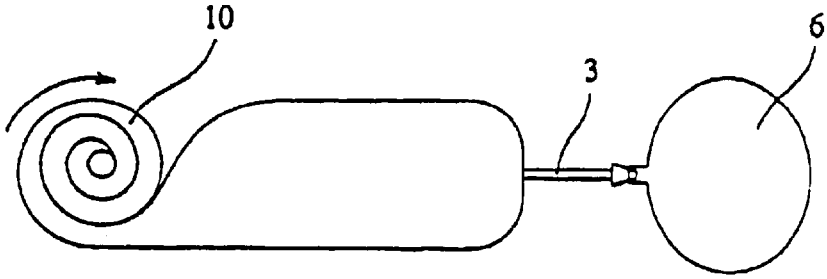

In case that the pressure of the Helium gas in the inner bag 2 becomes low as the Helium gas flows into balloons 6, the Helium gas can further be transferred into the balloon 6 by pressing the outer fabric made bag 10 from outside, for instance, rolling the bag 10 as shown in FIG. 4(*b*). Then the gas in the inner bag 2 is pushed out and transferred in the balloon 6 through the inlet/outlet 3. Therefore, by pressing the outer bag 10 completely, all of the Helium gas contained in the inner bag 2 can be transferred into the balloon 6 without leaving any gas in the inner bag 2.

If a material having a high gas barrier characteristic and a water-soluble characteristic, for instance, polyvinyl alcohol (PVA), is used for the inner bag 2, it is possible to wash out the used inner bag 2, which would dissolve in water. Therefore, in case that an inner bag 2 having such a characteristic is used with the container body 1 made of thin paper, such as a corrugated cardboard, the container can be used for manufacturing recycled paper just by immersing the container into water to wash the inner bag 2, which would dissolve in the water. On the other hand, in the case that an inner bag 2 having such a character is used with the container body 1, which is made of fabric, the container can be used again in such a manner that the container as a whole is immersed in water to wash the bag 2 out, then allowing the container body 10 to get dry and putting a new inner bag 2 therein. This is also friendly to the environment.

Figure 5:
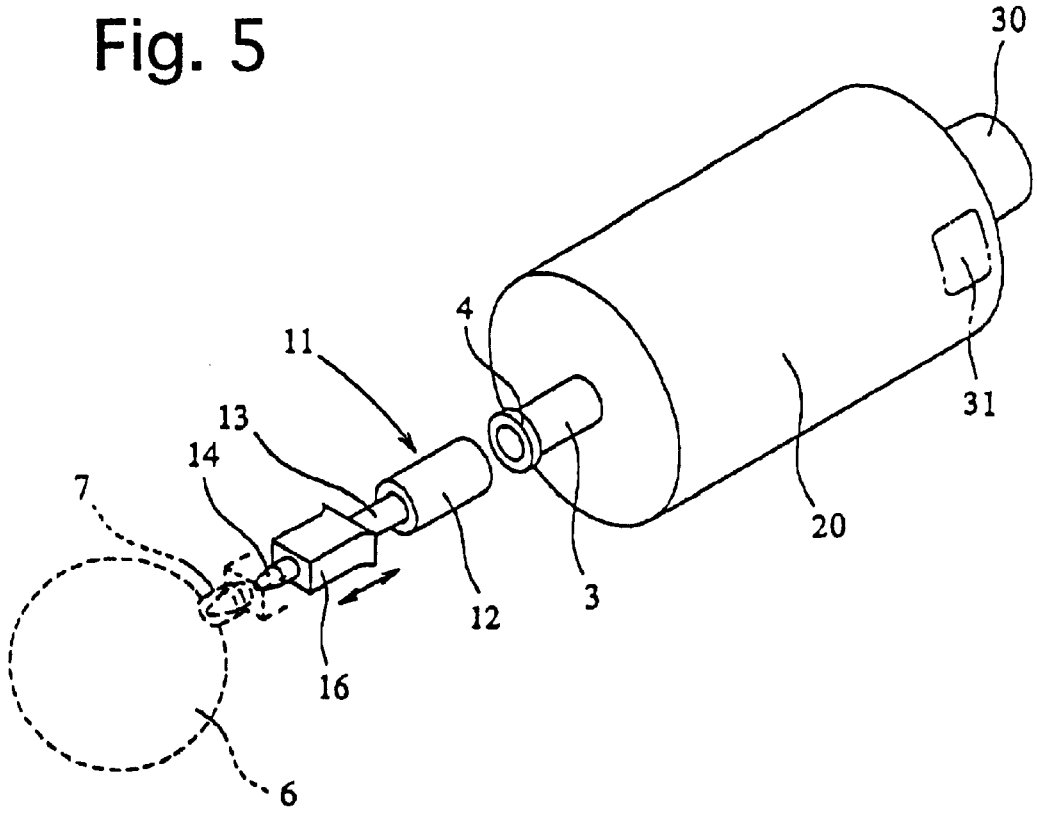
FIG. 5 is a perspective view illustrating a third embodiment of the gas container according to the present invention.

FIG. 5 shows the third embodiment of the gas container according to the present invention. According to the third invention, Helium gas is contained in a bag 20 which does not have any outer container body. The bag 20 is made of a thick 25 synthetic resin, such as PVA, which has a gas barrier characteristic. The Helium gas is charged through the inlet/outlet 3 which is formed within the bag 20, and discharged therethrough by applying a pressure against the bag 20 from the outside. It may be possible to cover the outer or inner surface of the bag 2 with a thin metal film, such as an aluminum film. In this embodiment, a high density of the bag 20 is obtained by 30 using a thick material for the bag 20 so that no container body is necessary. Therefore, the construction of the container is simple and thus the manufacturing cost of the container can be reduced. It is desirable that the outlet/inlet 3 is bent or tied during transportation, or during connection to or disconnection from the pump 11, as shown in FIGS. 2(*a*) and 2(*b*), and as described in connection with the first embodiment above.

Further, it is preferred to discharge the gas contained in the bag 2 by means of a pump 11. The pump 11 comprises a cylinder 12 and a piston pipe 13 which is reciprocally movable in the cylinder 12; the top end of the piston pipe 13 is protruded from the cylinder 12. At the top end of the pipe 13, a nozzle 14 is provided; at the rear end of the pipe 14, a packing 15 is provided being urged against the inner surface of the cylinder 12 to keep an airtightness in the cylinder 12. In the vicinity of the nozzle 14, a handle 16 is provided. Since the construction of the pump 11 is well known, the detailed explanation is omitted here.

Figure 6:
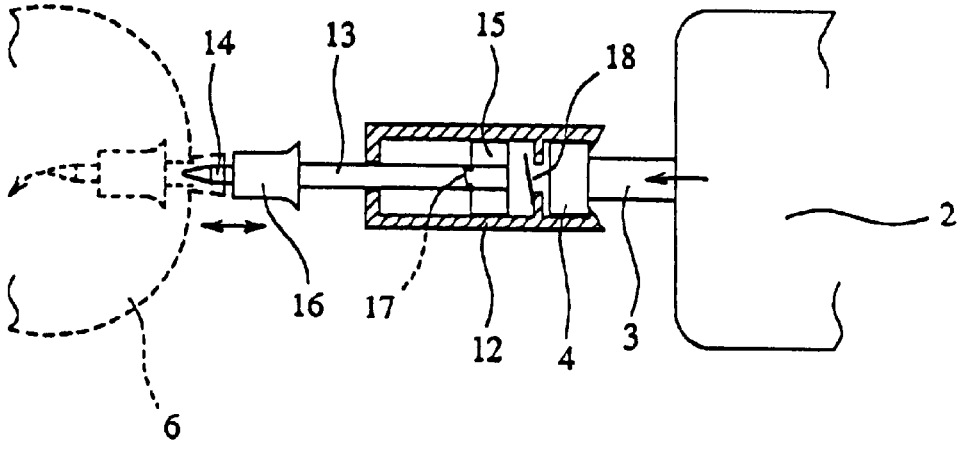
FIG. 6 is a schematic view representing a modification of the gas container according to the present invention.

According to the gas container shown in FIG. 6, Helium gas is injected into the balloon 6 in such a manner that the nozzle 14 attached to the pipe 13 of the pump 11 is inserted into the inlet 7 of the balloon 6; the pipe 13 is reciprocally moved manually, which can be easily done by an operator by holding the handle 16. By the reciprocal moving of the pipe 13, the Helium gas contained in the bag 2 is transferred into the balloon 6 through the outlet/inlet 3 and the pump 11 to inflate the balloon 6 with the Helium gas.

It should be noted that when the pipe 13 is inserted into the cylinder 12, a valve 17 provided in the pipe 13 is open and a valve 18 provided in the cylinder 12 is closed; while, when the pipe 13 is protruded from the cylinder 12, the valve 17 is closed and the valve 18 is open.

By using a pump 11, it is possible to transfer Helium gas in the bag 2 into the balloon 6 by a pressure of the pump. Therefore, the container having a pump can be used to charge Helium gas not only into balloons, which can be inflated and kept in the air with an atmospheric pressure, like UFO balloons, but also into rubber balloons which require to be inflated with a higher pressure than one atmospheric pressure.

According to the gas containers shown in FIG. 1 and FIG. 3, the Helium gas in the bag 2 is effectively discharged at the beginning. However, after the remaining gas becomes small, it becomes difficult to discharge the gas because even if the operator presses the container body 1, the gas moves to the portion where no pressure is applied. Therefore, it is difficult to completely discharge all the gas according to the containers shown in FIGS. 1 or 3. However, by using a pump 11, all of the remaining gas can be easily discharged; in addition it is also possible to inflate balloons with a higher pressure than one atmospheric pressure.

Further, it is also preferred to provide a member 20 at a bottom of the bag 2 so as to be protruded from the peripheral portion of the bottom, so that it can be prevented that the bag 2 as a whole rises up by stopping the member 30 by an operator's foot and it is possible to keep the bag standing in a vertical manner. In a condition that the container is kept standing, the remaining gas can be discharged easily because the Helium gas, which is light, is collected to the vicinity of the outlet/inlet 3 of the bag 2. Alternatively, it may be preferred to put a double-side adhesive tape 31 on the outer surface of the bag at the bottom thereof as shown in FIG. 6. The tape is attached to a suitable and stable member to keep the bag 2 standing.

It should be noted that the protruded member 20 or the double sided adhesive tape 21 may also be applied to the first and second embodiments shown in FIGS. 1 and 3, respectively.

In the above-mentioned embodiments, Helium gas is charged in the container 1. However, the present invention can also be used for Oxygen gas, Nitrogen gas, etc. Further, the pump is not limited to a manual type pump mentioned in FIG. 6, so that a foot pump, an electric pump, etc. can also be used therefor.

As explained in the above, according to the first aspect of the present invention, an inner bag charged with a gas is contained in a deformable container body, so that the gas contained in the inner bag can be discharged through an outlet/inlet of the container by pressing the container body from outside to transform the container. Therefore, it is unnecessary to charge a gas in the container with a high pressure, and all of the gas contained in the container can be effectively used by pressing the container without leaving remaining gas waste in the container.

Further, according to the present invention, the container body is made of corrugated cardboard material, which is easily deformed by pressing it from outside and then all of the gas in the container is easily discharged. In addition the container body can be re-cycled or burnt.

Furthermore, according to the second aspect of the present invention, the container body itself is deformed very easily so that all of the gas contained in the body can be completely discharged. In addition, the container body can be repeatedly used by exchanging the inner bag only.

Furthermore, according to the third aspect of the invention, the inner bag is made of a water-soluble material. Therefore, the container body itself can be recycled or reused by washing the inner bag out into the water.

Furthermore, according to the fourth aspect of the invention, the inner bag has an intensity which is sufficiently strong to contain a gas without using a particular container body. Therefore, the construction thereof becomes very simple so that the manufacturing cost thereof becomes cheap.

Moreover, according to the fifth aspect of the invention, the remaining gas in the inner bag can be easily discharged by means of the pump, and further it is possible to inflate balloons with a gas having a higher pressure than one atmosphere pressure.

Moreover, according to the sixth aspect of the invention, the gas container can easily keep its posture in a vertical manner, so that the gas held in the container is transferred without leaving any remaining waste gas.

What is claimed is:

1. A gas container comprising a deformable outer container body, having a top end and a bottom end, an inner bag having a characteristic as a high gas barrier, being held in said outer container body, and a gas supply means being formed within said inner bag at a location adjacent the top end and protruding through to the outside of the outer container at a top end thereof, and a pump means attached to the gas supply means for discharging gas held in the inner bag, the gas supply means comprising a means for controlling discharge of gas through the gas supply means by opening or closing the gas supply means.

2. A gas container according to claim 1, wherein said outer container body is made of a thick paper material.

3. A gas container according to claim 1, wherein said outer container body is made of a non-stretchable fabric.

4. A gas container according to claim 1, wherein said outer container body comprises a thin member being protruded from the bottom of the outer container body.

5. A gas container according to claim 1, wherein said outer container body comprises a holding means in the vicinity of the bottom of the outer surface of the outer container body so that the outer container body can keep its posture in a vertical manner by attaching the holding means to a stable member.

6. A gas container comprising a bag being made of a thick synthetic resin having a gas barrier characteristic, and having a top end and a bottom end, and a gas supply means being formed within said bag at a location adjacent top end and protruding through to the outside of the bag at the top end thereof, and a pump means attached to the gas supply means for discharging gas held in the bag, the gas supply means comprising a means for controlling discharge of gas through the gas supply means by opening or closing the gas supply means.

7. A gas container according to claim 6, wherein said bag comprises a thin being protruded from the bottom of the bag.

8. A gas container according to claim 6, wherein said bag comprises a holding teans in the vicinity of the bottom of the outer surface of the bag so that the bag can keep its posture in a vertical manner by attaching the holding means to some stable member.

* * * * *